United States Patent [19]

Goudreau

[11] 4,068,785

[45] * Jan. 17, 1978

[54] BALL HOLDER CONNECTOR

[75] Inventor: Noel G. Goudreau, Bradley, Ill.

[73] Assignee: Icon American International, Inc., Kankakee, Ill.

[ * ] Notice: The portion of the term of this patent subsequent to Mar. 25, 1992, has been disclaimed.

[21] Appl. No.: 660,189

[22] Filed: Feb. 23, 1976

[51] Int. Cl.[2] ..... A63B 61/00

[52] U.S. Cl. ..... 224/5 D; 224/45 L; 273/32 D; 206/315 B

[58] Field of Search ..... 206/315 B; 224/5 D, 224/45 L, 5 R, 5 A, 5 C, 26 R, 26 B, 26 D, 26 E, 26 K, 26 G, 26 J, 28 R, 28 B, 29 B; 273/32 D; 24/81 A, 83

[56] References Cited

U.S. PATENT DOCUMENTS

| | | | |
|---|---|---|---|
| 2,665,830 | 1/1954 | Fowler | 224/5 D |
| 2,801,105 | 7/1957 | Acton | 224/45 L X |
| 2,985,349 | 6/1961 | McGuire | 224/5 A |
| 3,873,009 | 3/1975 | Goudreau | 224/5 D |

FOREIGN PATENT DOCUMENTS

| | | | |
|---|---|---|---|
| 573,899 | 4/1959 | Canada | 224/45 L |
| 1,056,460 | 2/1964 | France | 224/45 L |
| 326,425 | 3/1930 | United Kingdom | 224/5 D |

*Primary Examiner*—Robert J. Spar
*Assistant Examiner*—Jerold M. Forsberg
*Attorney, Agent, or Firm*—Anthony S. Zummer

[57] ABSTRACT

A ball holder connector construction is particularly adapted for snap connecting a base and a retaining ring of a ball holder. A base connector tongue is formed integral with the base. An aperture is formed in the base connector tongue. A retaining ring connector tongue is formed integral with the retaining ring. The retaining ring connector tongue has a hook formed integral therewith, which is adapted to pass through the aperture of the base connector tongue. The hook is adapted to engage lockingly the base connector tongue. The base connector tongue and the retaining ring connector tongue together comprise the ball holder connector.

7 Claims, 6 Drawing Figures

BALL HOLDER CONNECTOR

BACKGROUND OF THE INVENTION

Some sports in which a ball is used require more than one ball for efficiency of play. For instance, in tennis it is customary when serving to serve a first ball and then if the serve is found to be improper, a second ball should be served immediately thereafter. Usually a person playing tennis keeps two or three balls in his court so that the play of the game will not be broken up by continuously having to retrieve balls. Customarily a person playing tennis either holds the extra tennis balls in his hand or keeps them in his pocket. In either case, the chore of handling the additional tennis balls is undesirable and detracts from the pleasures of the game.

U.S. Pat. No. 3,873,009, directed to a Ball Holder, discloses a two-piece tennis ball holder adapted for wearing on a garment. The two-piece tennis ball holder has a base having a spherical curvature. The base acts as a cup to hold the tennis ball. In addition, the base has a pair of fingers which are adapted to engage a belt or garment. A retaining rim is connected to the base to hold a tennis ball in the base. A tongue 24 is formed integral with the base. A retaining ring tongue 60 is formed integral with the retaining ring. The base is connected to the retaining ring by sonically welding the two tongues together.

The ball holder is used by slipping a tennis ball between the cup portion of the base and the retaining ring thereby causing a displacement of the retaining ring with respect to the cup. This displacement places a stress on the sonic weld which holds the two tongues together. If the stress is of sufficient magnitude, the weld will break. Therefore, it is often difficult to determine whether the sonic weld is a good join. The manufacturer may be uncertain as to the quality of the join between the base and the retaining ring. The only way that the weld can be tested is by placing a sufficient stress on the retaining ring to fracture the weld. This is clearly undesirable.

What is needed then is a construction which will connect the base to the retaining ring and will provide immediate indication as to whether the connection made is a strong one.

SUMMARY OF THE INVENTION

The present invention relates to a ball holder connector which is adapted to hold a base of a ball holder in snap connection with a retaining ring of a ball holder. The base and the retaining ring are both molded from plastic. The base has a cavity which is formed in the shape of a sphere. A pair of fingers is mounted on the base to provide a clip for securing the base to a player's clothing. The base includes a base connector tongue which is formed integral with and projects from an upper portion of the base. The base connector tongue has an aperture formed therein. The base connector tongue forms one portion of the ball holder connector.

The retaining ring includes a retaining ring tongue projecting from a portion of the retaining ring. The retaining ring tongue has a hook formed integral with the retaining ring tongue. A tab is also formed integral with the retaining ring tongue adjacent the hook. The hook of the retaining ring tongue is adapted to pass through the aperture of the base connector tongue and to engage lockingly the base connector tongue. The tab of the retaining ring tongue is also adapted to engage compressionally an end portion of the base connector tongue. The retaining ring tongue forms another portion of the ball holder connector.

It is, therefore, a principal object of the present invention to provide a ball holder connector which is adapted to connect a pair of resilient plastic elements of a ball holder.

It is another object of the present invention to provide a ball holder connector which may be visually inspected to assure good connection.

It is a further object of the instant invention to provide a ball holder connector which lockingly engages when a force is applied to it.

It is still another object of the present invention to provide a ball holder connector which may be easily and quickly assembled.

Other objects and uses of the herein disclosed invention will become readily apparent to those skilled in the art upon a perusal of the following specification in light of the accompanying drawings.

DESCRIPTION OF THE PREFERRED EMBODIMENT

Figure 1:
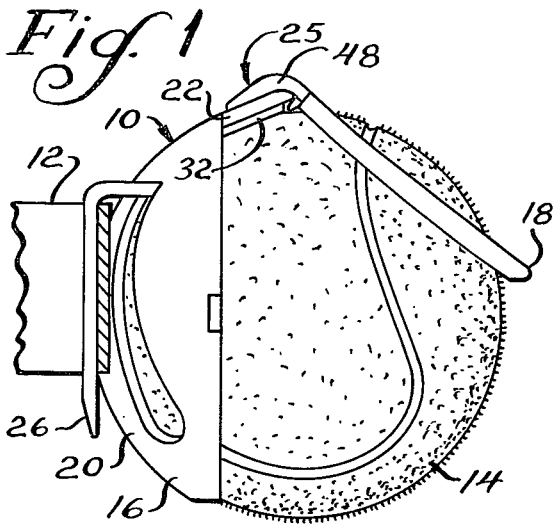
FIG. 1 is a side elevational view of a ball holder embodying the connector of the present invention shown mounted on an article of clothing and shown with a tennis ball held therein.
Figure 2:
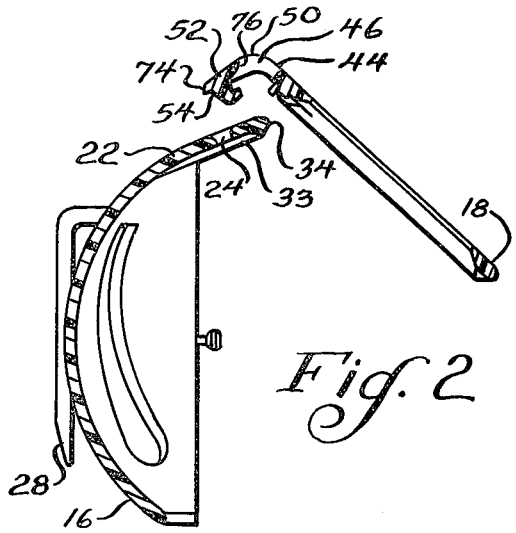
FIG. 2 is a cross-sectional exploded view of the ball holder of FIG. 1.

Referring now to the drawings, and especially to FIG. 1, a tennis ball holder generally indicated by numeral 10 is shown therein mounted on a belt 12, with a tennis ball 14 held in holder 10. The ball holder 10 generally consists of two main portions, an injection-molded plastic base 16 and an injection-molded plastic retaining ring 18. In this instance, plastic for each of the parts is acetal resin; and specifically, Delrin 500 manufactured by E. I. duPont de Nemours & Co.

The base 16, as was mentioned above, is an injection-molded part. The base has a cavity defining a portion of a sphere less than a hemisphere. The base has a body 20 which generally has a substantially uniform thickness. A base connector tongue 22 is formed integral with one edge of the body 20. Base connector tongue 22 extends tangentially from base 16. Base connector tongue 22 is substantially flat. The base connector tongue 22 includes an aperture 24. Base connector tongue 22 forms one portion of a ball holder connector 25. A pair of fingers 26 and 28 are formed integral with body 20 of base 16.

Figure 3:
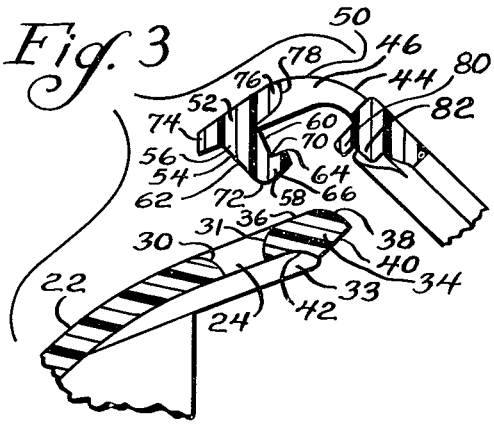
FIG. 3 is a cross-sectional view of a portion of the ball holder of FIG. 2 showing details of the construction of the base connector tongue and the retaining ring tongue.

Referring now to FIG. 3, aperture 24 has a pair of inwardly curving sides 30 and 31. A support rib 32 is positioned adjacent aperture 24. A support rib 33 is positioned adjacent aperture 24 and opposite support rib 32. Inwardly curving sides 30 and 31 have approximately 90° of curvature. Inwardly curving side 31 is also a cam surface. A base connector bar 34 is formed integral with and perpendicular to support ribs 32 and 33. Base connector bar 34 is shaped like a comma. Base connector bar 34 has a flat face 36 formed immediately adjacent cam surface 31. A rounded face 38 is formed immediately adjacent flat face 36. Rounded face 38 has approximately 75° of curvature. A flat tab shoulder 40 is formed perpendicular to an edge of curved face 38. A bottom face 42 is formed immediately adjacent tab shoulder 40. Bottom face 42 has curvature substantially parallel to that of curved face 38. Base connector bar 34 is widest at tab shoulder 40 and tapers to a line where cam surface 31 and bottom face 42 meet.

A retaining ring tongue 44 is formed integral with retaining ring 18. Retaining ring tongue 44 has an aperture 46 formed therein. Aperture 46 is bounded by a pair of tapered curving legs 48 and 50. Legs 48 and 50 are formed integral with retaining ring 18 and are curved approximately 75°. Retaining ring tongue 44 forms another portion of ball holder connector 25.

A tapered shelf 52 is formed integral with and perpendicular to legs 48 and 50 opposite retaining ring 18. A hook 54 is formed integral with shelf 52. Hook 54 has a tapered leg 56 and a tapered lip 58. Leg 56 has a pair of tapering sides 60 and 62. Sides 60 and 62 have approximately a 15° taper. Lip 58 has a pair of tapering sides 64 and 66. Sides 64 and 66 likewise have approximately a 15° taper. Sides 64 and 66 end in a flat lip face 68. Side 60 and side 64 are perpendicular to each other and meet at a line 70. Sides 62 and 66 are also perpendicular to each other but meet in a curved fillet 72.

A hook stop 74 is formed integral with a portion of shelf 52 adjacent leg 56 of hook 54 and opposite aperture 46. A hook shoulder 76 having a curved edge 78 is formed immediately adjacent leg 56 of hook 54 and opposite hook stop 74. A rectangular tab 80 is formed integral with a side of aperture 46 opposite hook shoulder 76. Tab 80 is positioned approximately parallel to the side 66 of lip 58. A tab reinforcement 82 is formed integral with tab 80 opposite aperture 48.

Figure 4:
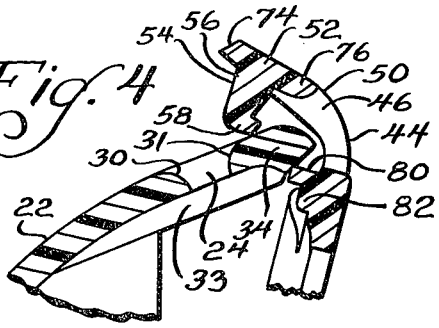
FIG. 4 is a cross-sectional view of the base connector tongue and retaining ring tongue of FIG. 3 in which the base connector tongue and retaining ring tongue are positioned at the beginning of the assembly process.
Figure 5:
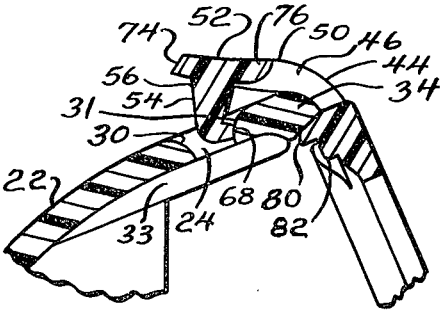
FIG. 5 is a cross-sectional view of the base connector tongue and retaining ring tongue of the ball holder of FIG. 4 showing the relative positions of the two tongues as they are being snapped together.
Figure 6:
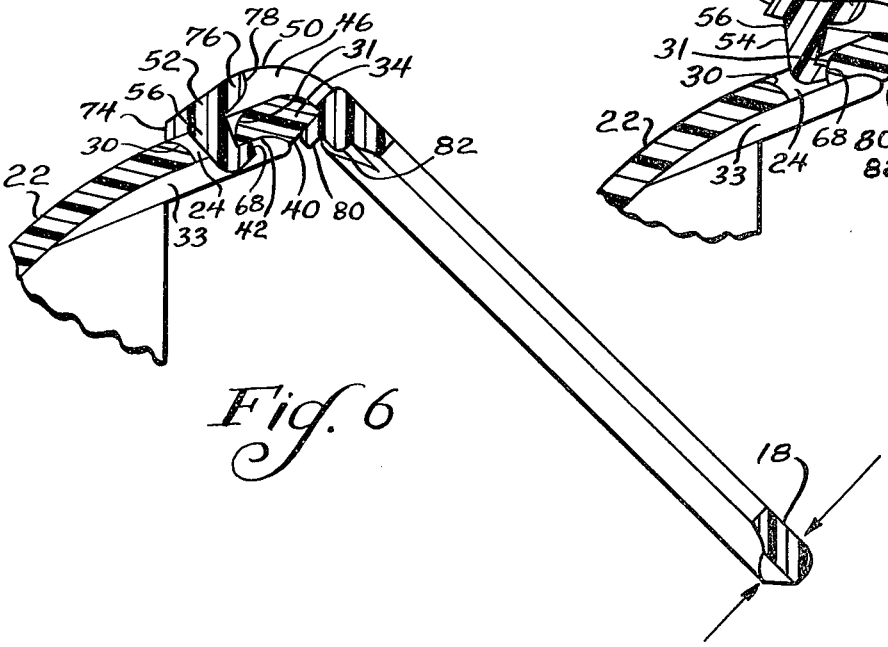
FIG. 6 is a cross-sectional view of a portion of the ball holder of FIG. 1 showing details of the position of the base connector tongue and retaining ring tongue when they are snapped together.

Referring now to FIGS. 4, 5 and 6, base connector tongue 22 is positioned in operative engagement with retaining ring tongue 44. In order to connect the two tongues together, tab 80 is first positioned against tab shoulder 40. Hook lip 58 is then rotated into contact with flat face 36 of base connector bar 42. Torque is then applied to retaining ring 18 to force lip face 68 of hook lip 58 along flat face 36 and cam surface 31 while bringing tab 80 into full engagement with tab shoulder 38. Leg 56 of hook 54 is resiliently forced back as hook 54 follows cam surface 31. Legs 48 and 50 also flex as an edge of lip face 68 rides over cam surface 31 of connector bar 42. Tab reinforcement 82 provides compressional support for tab 80 as it is forced against tab shoulder 38. Aperture 46 allows easier flexure of legs 48 and 50 as base connector tongue 22 and retaining ring tongue 44 are being snapped together. When hook lip 58 clears cam surface 31, hook 54 snaps resiliently into engagement with connector bar 34.

Tab 80 is abutted against tab shoulder 40 when base connector tongue 22 is fully engaged by retaining ring tongue 44. Legs 48 and 50 of retaining ring tongue 44 are mateably engaged by curved side 38 and flat face 36 of connector bar 34. Lip side 64 of hook 54 is snapped into engagement with bottom face 42 of connector tongue 22.

Leg 56 of hook 54 is held in tensile stress by base connector bar 34. Hook stop 74 is in contact with inwardly curving side 30 of aperture 24 to hold hook lip 58 against bottom face 42.

When a force is applied to retaining ring 18 tending to move it away from face 38, a corresponding torque is transmitted through retaining ring tongue 44 to cause the tensile stress in hook leg 56 and lip 58 to increase and thereby to engage more forceably base connector bar 34. In a similar fashion, if a force directed toward base 16 is applied to retaining ring 18, tab 80 is forced into greater compressional engagement with tab shoulder 40 of base connector bar 42. Support ribs 32 and 33 prevent flexure of base connector tongue 24 when a force is applied to retaining ring 18. Thus, when stressed, retaining ring connector tongue 44 more forceably engages base connector tongue 22.

It may be appreciated that the construction of the base connector tongue may be formed integral with the retaining ring and that the construction of the retaining ring tongue may be formed integral with the base, thus reversing the positions of the two tongues.

It may also be appreciated that the retaining ring may be easily snap-connected to the base by following the procedure herein above described.

It may be also appreciated that visual inspection will disclose when the two tongues are in proper engagement.

Although a specific embodiment of the present invention has been shown and described in detail above, it is readily apparent that those skilled in the art may make various modifications and changes in the subject invention without departing from the spirit and scope of the present invention. It is to be expressly understood that the instant invention is limited only by the appended claims.

What is claimed is:

1. In a ball holder adapted for readily removably holding a ball on a person of a player having a first portion having a cavity defining a portion of a sphere less than a hemisphere, said sphere having a diameter approximately the diameter of the ball; a clip connected to the first portion for securing the ball holder to an article of clothing worn by the player; and a second portion resiliently connected to the first portion; said second portion being adapted for engagement with and retention of a ball positioned in the cavity; the improvement comprising: a first tongue connected to one of said portions, an aperture formed in said first tongue; and a second tongue connected to the other of said portions, a hook connected to said second tongue, said hook being adapted to pass through said aperture of said first tongue to engage lockingly said first tongue.

2. In a ball holder as defined in claim 1 including a connector bar connected to said first tongue; and a tab connected to said second tongue, said tab being adapted to engage compressionally said connector bar of said first tongue.

3. In a ball holder as defined in claim 1 wherein said aperture is a rectangular aperture having a pair of opposite inwardly curving walls.

4. In a ball holder as defined in claim 1 wherein a second aperture is formed in said second tongue, said second aperture being adapted to promote flexure of said second tongue.

5. In a ball holder as defined in claim 1 wherein said hook includes a tapered leg connected to said second tongue; and a tapered lip connected to said tapered leg.

6. In a ball holder as defined in claim 1 in which said second tongue has a compression tab and said first tongue has a connector bar, said compression tab and said hook of said second tongue being adapted to engage compressionally said connector bar of said first tongue.

7. In a ball holder adapted for readily removably holding a ball on the person of a player having a base having a cavity defining a portion of a sphere less than a hemisphere, said sphere having a diameter approximately the diameter of the ball; a clip connected to the base for securing the ball holder to an article of clothing worn by the player; and a retaining ring resiliently connected to the base; the improvement comprising: a base connector tongue formed integral with said base; a base aperture formed in said base connector tongue; a pair of inwardly curving walls bordering said base aperture; a connector bar positioned immediately adjacent one of said inwardly curving walls of said base aperture, said connector bar having a flat tab shoulder, said connector bar having a curved bottom face; a retaining ring tongue formed integral with said retaining ring; a tab formed integral with said retaining ring tongue, said tab being adapted to engage compressionally said flat tab shoulder of said connector bar; a retaining ring aperture formed in said retaining ring tongue adjacent said tab, said retaining ring aperture being adapted to allow flexure of said retaining ring tongue; a tapered leg formed integral with said retaining ring tongue; and a tapered lip formed integral with said tapered leg, said tapered leg and said tapered lip being adapted to pass through said retaining ring aperture and to engage compressionally said connector bar.

* * * * *